US005870825A

United States Patent [19]

Moser

[11] Patent Number: 5,870,825

[45] Date of Patent: Feb. 16, 1999

[54] METHOD OF MAKING UNITARY HEAT EXCHANGER CORE

[75] Inventor: George Moser, Wixom, Mich.

[73] Assignee: Behr America, Inc., Walled Lake, Mich.

[21] Appl. No.: 949,626

[22] Filed: Oct. 14, 1997

Related U.S. Application Data

[62] Division of Ser. No. 753,512, Nov. 26, 1996, Pat. No. 5,758,720.

[51] Int. Cl.[6] ..... B23P 15/26

[52] U.S. Cl. ..... 29/890.046; 29/890.045

[58] Field of Search ..... 165/148, 171; 29/890.046, 890.045, 890.05, 428, 557

[56] References Cited

U.S. PATENT DOCUMENTS

| | | | |
|---|---|---|---|
| 2,175,394 | 10/1939 | Hewel . | |
| 2,924,437 | 2/1960 | Wilkins . | |
| 3,229,766 | 1/1966 | Keith . | |
| 3,273,227 | 9/1966 | Pauls . | |
| 3,294,162 | 12/1966 | Loehlein et al. . | |
| 3,333,317 | 8/1967 | Shockley | 165/183 |
| 3,406,750 | 10/1968 | Pauls . | |
| 3,457,756 | 7/1969 | Rohde | 165/183 |
| 3,495,657 | 2/1970 | Keith . | |
| 3,611,534 | 10/1971 | Keith . | |
| 3,727,682 | 4/1973 | Pasternak | 165/183 |
| 3,866,286 | 2/1975 | Pasternak . | |
| 4,071,934 | 2/1978 | Zolman et al. . | |
| 4,830,100 | 5/1989 | Kato et al. . | |
| 4,949,543 | 8/1990 | Cottone et al. | 165/181 |
| 5,490,559 | 2/1996 | Dinulescu | 165/183 |
| 5,647,433 | 7/1997 | Sasaki . | |

*Primary Examiner*—Irene Cuda
*Attorney, Agent, or Firm*—Howard & Howard

[57] ABSTRACT

A method for making a heat exchanger assembly (10) includes the steps of simultaneously extruding hollow tubes (12) and bridges (14) integrally connecting adjacent tubes (12) through a die; and cutting holes (16) into the bridges (14) to allow airflow through the holes (16). The holes (16) are cut into the bridges (14) by cutting tongues (18, 118) into the bridges (14) and bending the tongues (18, 118) transversely to the tubes (12). Fin modules (20) are then inserted into each hole between the hollow tubes (12) to provide alternative heat exchange characteristics to those of the tongues (20) acting as the fins.

3 Claims, 2 Drawing Sheets

FIG-1
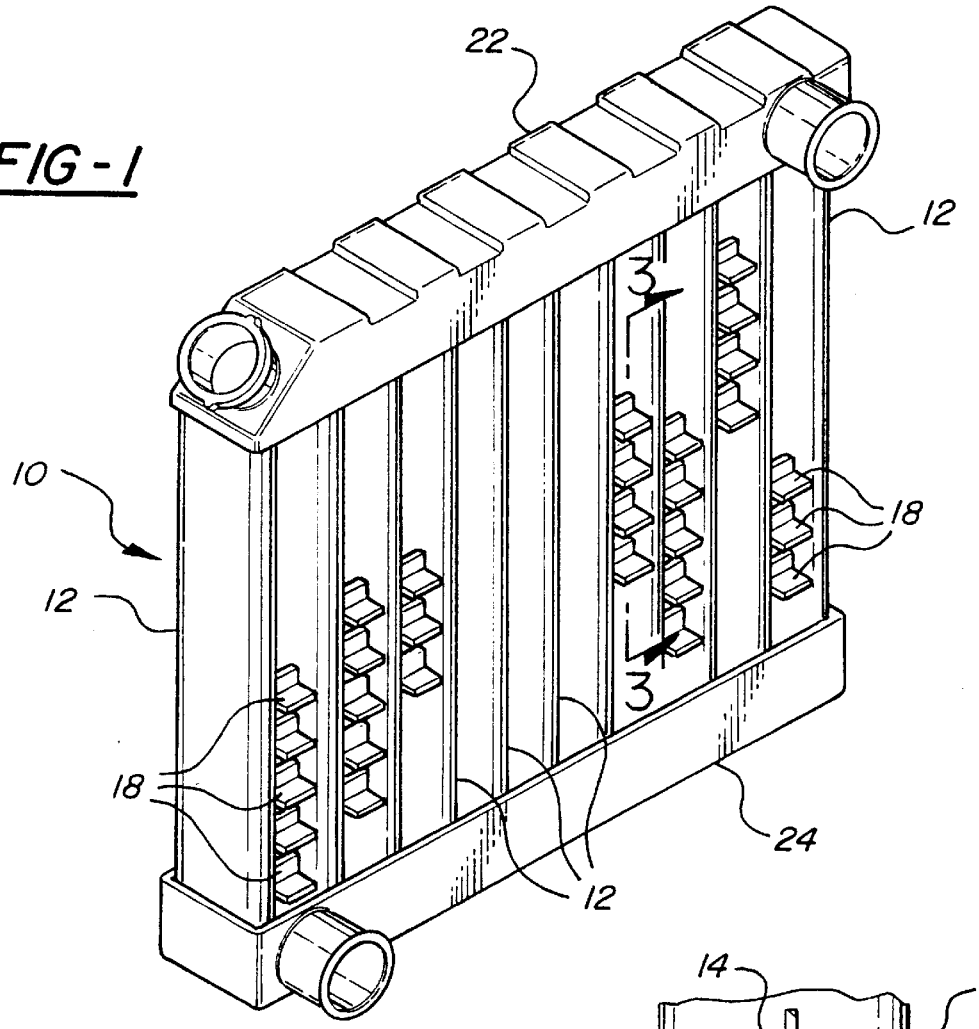
FIG-2
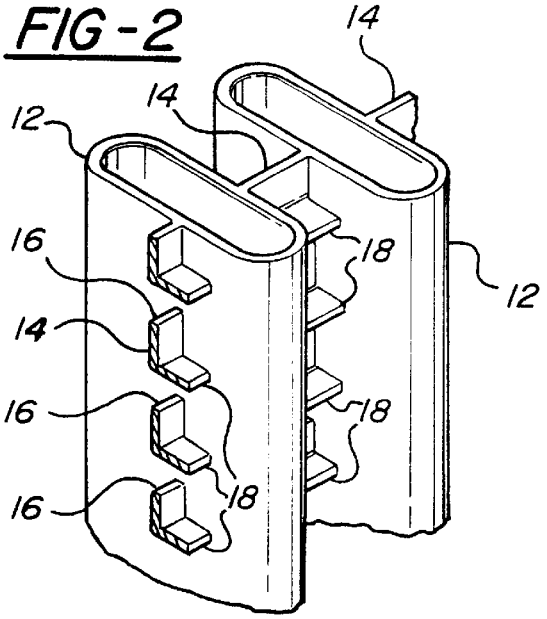
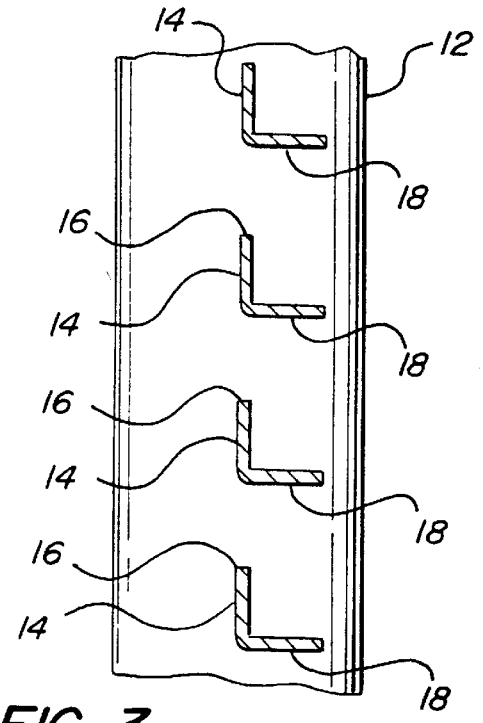
FIG-3

FIG-4
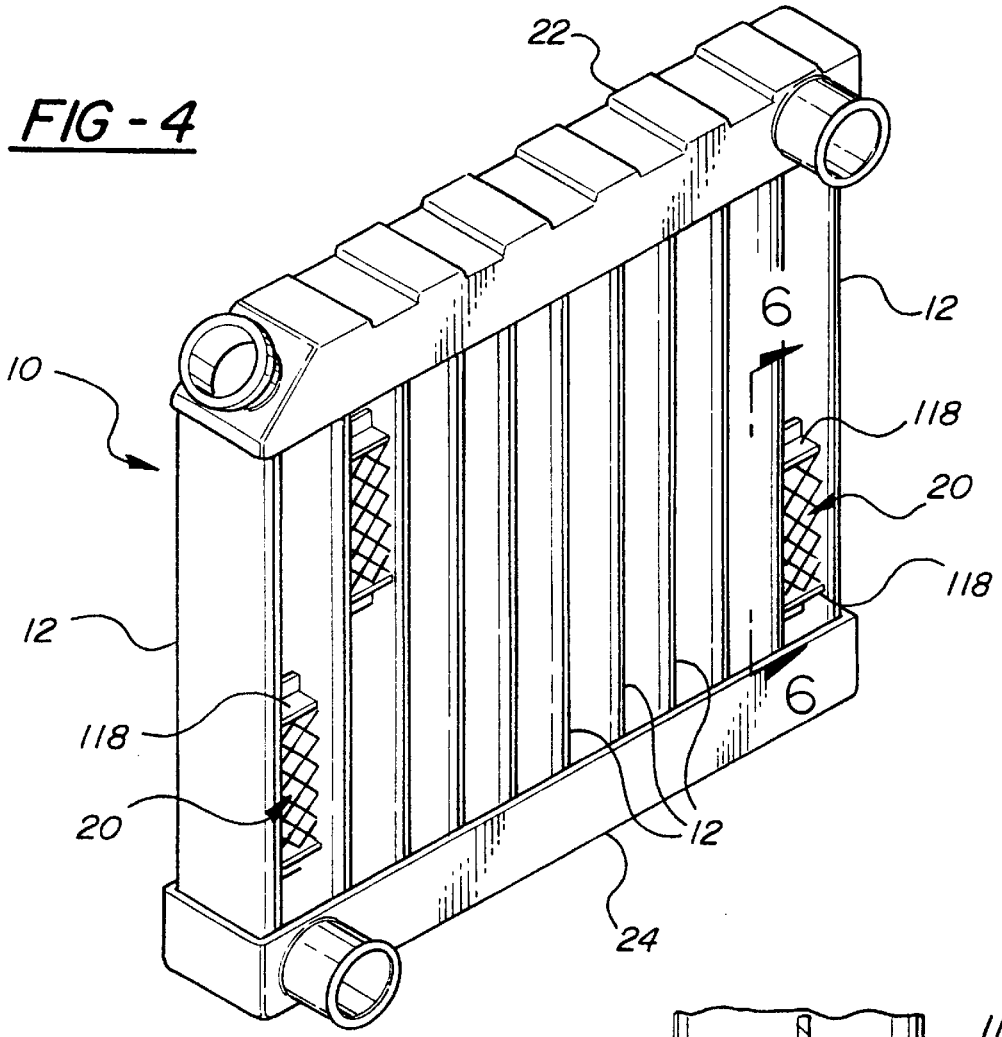
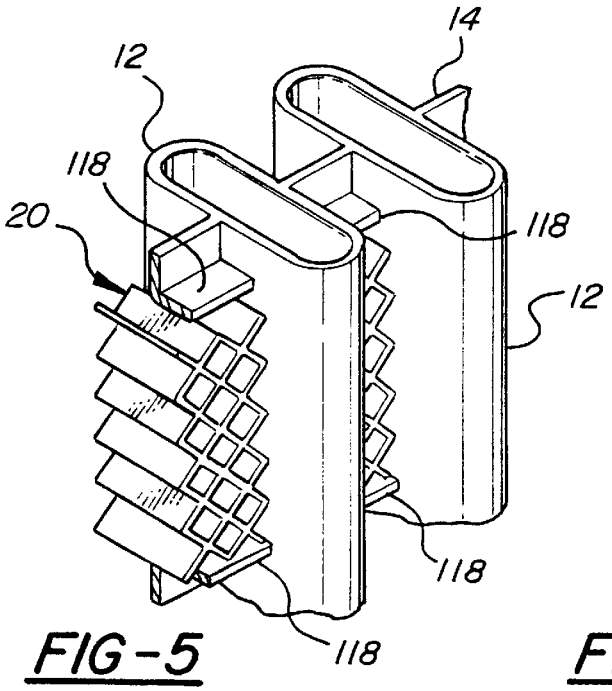
FIG-5
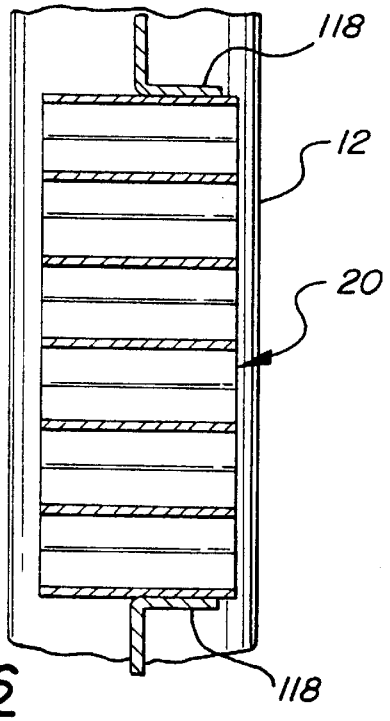
FIG-6

METHOD OF MAKING UNITARY HEAT EXCHANGER CORE

RELATED APPLICATION TECHNICAL FIELD

This is a Divisional of application Ser. No. 08/753,512 filed on Nov. 25, 1996 now U.S. Pat. No. 5,758,720.

This invention relates to a heat exchanger assembly of the type for transferring heat between a liquid and ambient air and method of making the same.

BACKGROUND OF THE INVENTION

The object of a heat exchanger assembly is to maximize heat transfer efficiency at the lowest possible manufacturing cost. Such heat exchangers include adjacent hollow tubes interconnected by fins. Typically, the tubes and fins are bonded together by a brazing process in an oven. This method is disclosed in U.S. Pat. Nos. 4,949,543, 5,042,574, 5,102,032, and 5,277,358, all to Cottone et al. To address the problem of bonding the fins to the tubes, U.S. Pat. No. 3,333,317 to Shockley discloses a method for making a heat exchanger by making individual hollow tubes with integral fins. In yet another disclosure, U.S. Pat. No. 5,490,559 to Dinulescu, a fin module is extruded having a flat wall for bonding with the flat wall of a hollow tube.

The prior art teaches the extrusion of a hollow tube having fins on one hand and the extrusion of a fin module on the other hand. Although the prior art methods and assemblies function satisfactorily, there remains a need to reduce the cost of manufacturing while meeting heat transfer requirements.

SUMMARY OF THE INVENTION A ADVANTAGES

A heat exchanger assembly comprising a plurality of hollow tubes, and a bridge integrally interconnecting adjacent tubes for transferring heat of a liquid. The method for making the heat exchanger comprises the steps of simultaneously extruding through a die the hollow tubes and bridges, with the bridges integrally interconnecting adjacent tubes, and cutting holes into the bridges to allow airflow through the holes between the hollow tubes.

The heat exchanger core is a single integral unit whereby the tubes are integrally interconnected by the bridges. Accordingly, the subject invention provides a heat exchanger in a single integral unit that is easily and economically fabricated.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a preferred embodiment;

FIG. 2 is an enlarged perspective and fragmentary view of the embodiment of FIG. 1;

FIG. 3 is a cross sectional view taken along line 3—3 of FIG. 1;

FIG. 4 is a perspective view of the invention with the addition of fin modules;

FIG. 5 is an enlarged perspective view and fragmentary view of the added fin modules of FIG. 4; and FIG. 6 is a cross sectional view taken along line 6—6 of FIG. 4.

DETAILED DESCRIPTION OF THE PREFERRED EMBODIMENT

Referring to the Figures, wherein like numerals indicate like or corresponding parts throughout the several views, a heat exchanger core assembly for transferring heat of a liquid is generally shown at 10 in FIGS. 1 through 3.

The assembly 10 comprises a plurality of hollow tubes 12 and bridges 14 integrally connecting adjacent tubes 12. The plurality of tubes 12 are interconnected by bridges 14 to form a heat exchanger core unit. Each bridge 14 includes holes 16 extending therethrough to allow airflow through the holes 16 between the hollow tubes 12. The holes 16 are cut out of the bridges 14 by cutting tongues 18 and bending the tongues 18 transversely or at 90 degrees; i.e., the tongues 18 extend integrally and transversely from the bridges 14. The holes 16 are defined by tongues 18 having a U-shaped tab portion before it is bent and having a hinge portion and a fixed portion after it is bent. The bottom of each tab portion of each tongue 18 before it is bent and the hinge portion of the same tongue 18 after it is bent define the holes 16. Therefore, the holes 16 cut through the bridge 14 are defined by the tongues 18 which are cut out of the bridge 14. As ambient air flows through the holes 16 in the bridges 14 heat is transferred between liquid in the tubes 12 and the ambient air.

The hinge portion of the tongues 18 is integrally interconnected to the bridge 14 and the tab portion is formed by cutting 3 slots into the bridge to form a U-shaped tab portion of the tongue 20. The U-shaped tab portion is bent about the hinge portion so that the tab portion extends transversely from the bridge 14. When the tab portion is bent, the tongue 18 forms an L-shape with the bridge when viewed in cross section.

The tongues 18 promote heat transfer, but in some cases a different fin configuration is desirable. As illustrated in FIGS. 4 through 6, a fin module, generally indicated at 20, may be supported in holes through the bridges 14. The fin modules 20 are disposed between oppositely facing and spaced tongues 118 extending integrally and transversely from the bridges 14. The spaced tongues 118 include a hinge portion and a tab portion bent about the hinge portion. The spaced tongues 118 are bent clockwise and counterclockwise respectively about the hinge portions. A first tongue 118 having a tab bent counterclockwise as viewed in FIG. 6 is located above the fin module 20 and a second tongue 118 is bent clockwise and is located below the fin module. The fin module 20 inserts between these spaced first and second tongues 118. The fin modules 20 have fins arranged for airflow to pass through. The fins are arranged in different arrangements for promoting heat transfer.

The heat exchanger core is attached to header tanks 22 and 24 which are in sealing engagement with each of the respective ends of the tubes 12. The header tank 22 fits on the top end and the header tank 24 fits on the bottom end of the tubes 12. The headers 22 and 24 are soldered to the tubes 12 to prevent leaks from occurring between the header tanks 22 and 24 and the tubes 12. The tanks 22 and 24 contain liquid which passes through the hollow tubes 12 of the heat exchanger core such that the temperature of the liquid is reduced. The liquid can be water, coolant or other liquids that need to be cooled. The heat exchanger core can be made of extrudable material such as aluminum or other similar types of extrudable materials.

The method for making a heat exchanger assembly 10 comprises the steps of simultaneously extruding through a die the hollow tubes 12 and bridges 14 integrally interconnecting adjacent tubes 12. The next step is the cutting of holes 16 through the bridges 14 to allow airflow through the holes 16 between the hollow tubes 12. The holes 16 are cut into the bridges 14 by cutting tongues 18 into the bridges 14 and bending the tongues 18 transversely to the tubes 12. The fin modules 20 are inserted into each hole between the hollow tubes 12 for support between spaced tongues 118. Alternatively, heat transfer can be achieved by allowing air to flow through the holes 16 that are made by cutting tongues 18 into the bridges 14, i.e., the tongues act as the heat transfer fins. In addition, the modules 20 may be supported in holes in the bridges without the tongues 118.

The step of disposing header tanks 22 and 24 about the respective ends of the tubes 12 allows liquid to be contained in the tanks before passing through the tubes 12 of the heat exchanger core and being cooled. The header tanks 22 and 24 are therefore disposed in sealing engagement with the respective ends of the tubes 12, e.g., soldered, brazed, or otherwise bonded to the tubes 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A method for making a heat exchanger assembly (10) comprising the steps of:

simultaneously extruding through a die hollow tubes (12) and bridges (14) with the bridges integrally interconnecting adjacent tubes (12); and cutting holes (16) through the bridges (14) to allow airflow through the holes (16) between the hollow tubes (12), and inserting a fin module (20) into each hole between the hollow tubes (12).

2. A method as set forth in claim 1 further described as cutting holes (16) by cutting tongues (20) into the bridges (14) and bending the tongues (20) transversely to the tubes (12) and supporting the fin modules (20) between spaced tongues (20) and hollow tubes (12).

3. A method as set forth in claim 1 including the step of disposing header tanks (24) about and in sealing engagement with respective ends of the tubes (12).

* * * * *